US006951454B2

(12) United States Patent
Sarv et al.

(10) Patent No.: US 6,951,454 B2
(45) Date of Patent: Oct. 4, 2005

(54) DUAL FUEL BURNER FOR A SHORTENED FLAME AND REDUCED POLLUTANT EMISSIONS

(75) Inventors: Hamid Sarv, Canton, OH (US); Ronald C. Lenzer, North Canton, OH (US)

(73) Assignee: The Babcock & Wilcox Company, New Orleans, LA (US)

( * ) Notice: Subject to any disclaimer, the term of this patent is extended or adjusted under 35 U.S.C. 154(b) by 0 days.

(21) Appl. No.: 10/443,287

(22) Filed: May 21, 2003

(65) Prior Publication Data

US 2004/0234912 A1 Nov. 25, 2004

(51) Int. Cl.[7] ..... F23C 1/12; F23D 1/02

(52) U.S. Cl. ..... 431/9; 431/8; 431/10; 431/181; 431/187; 431/183; 431/284; 110/262

(58) Field of Search ..... 431/9, 181, 182, 431/183, 184, 185, 187, 278, 284, 285, 349; 110/261, 262, 260; 239/552, 559, 567, 558, 565

(56) References Cited

U.S. PATENT DOCUMENTS

| | | | | | |
|---|---|---|---|---|---|
| 2,500,787 | A | * | 3/1950 | Lelgemann | 431/264 |
| 2,675,068 | A | * | 4/1954 | Gollus et al. | 431/349 |
| 2,862,545 | A | * | 12/1958 | Snow et al. | 239/422 |
| 3,002,553 | A | * | 10/1961 | Reed | 431/349 |
| 3,145,670 | A | * | 8/1964 | Cpian et al. | 431/184 |
| 3,279,705 | A | * | 10/1966 | Stiefel | 239/490 |
| 3,352,347 | A | * | 11/1967 | Bobson | 431/349 |
| 3,463,602 | A | * | 8/1969 | Bitterlich et al. | 431/188 |
| 3,574,508 | A | * | 4/1971 | Rothhaar et al. | 431/351 |
| 3,850,571 | A | * | 11/1974 | Zink et al. | 431/349 |
| 4,157,241 | A | * | 6/1979 | Samuelson | 431/353 |
| 4,439,401 | A | * | 3/1984 | Voll et al. | 422/150 |
| 4,479,442 | A | * | 10/1984 | Itse et al. | 110/261 |
| 4,604,048 | A | * | 8/1986 | Schwartz et al. | 431/8 |
| 4,685,882 | A | * | 8/1987 | Binasik et al. | 431/182 |
| 4,915,619 | A | * | 4/1990 | LaRue | 431/284 |
| 5,147,199 | A | * | 9/1992 | Perthuis et al. | 431/10 |
| 5,169,304 | A | * | 12/1992 | Flament et al. | 431/183 |
| 5,199,355 | A | * | 4/1993 | Larue | 110/261 |
| 5,697,306 | A | * | 12/1997 | LaRue et al. | 110/261 |
| 5,829,369 | A | * | 11/1998 | Sivy et al. | 110/347 |
| 5,860,600 | A | * | 1/1999 | Schindler et al. | 239/463 |
| 5,979,342 | A | * | 11/1999 | Leisse et al. | 110/264 |

FOREIGN PATENT DOCUMENTS

| | | | | |
|---|---|---|---|---|
| DE | 31 311962 | * | 2/1983 | |
| EP | 0014812 | * | 3/1980 | |
| EP | 0231628 | * | 12/1987 | |
| JP | 57-49707 | * | 3/1982 | |
| JP | 62-172105 | * | 7/1987 | |
| JP | 2002-286225 | * | 10/2002 | 431/8 |
| WO | WO 00/61992 | | 10/2000 | |

* cited by examiner

*Primary Examiner*—Carl D. Price
(74) *Attorney, Agent, or Firm*—Eric Marich; Michael J. Seymour; Kathryn W. Grant

(57) ABSTRACT

A dual fuel burner including an elongated supply pipe and a gas injector for a boiler furnace having a plurality of peripheral openings around a center opening. The peripheral openings are pitched radially away from the longitudinal axis of the gas injector and also pitched either clockwise or counter-clockwise, to impart a swirling motion to gaseous fuel exiting the injector through the openings. A first sleeve member is concentrically spaced about the supply pipe and the gas injector to form an inner annular passageway for conveying a mixture of primary air and pulverized coal to the furnace combustion zone. A second sleeve member is concentrically spaced about the first sleeve member to form an outer annular passageway for conveying secondary air to the furnace combustion zone, and a plurality of circumferentially spaced vanes mounted within the outer annular passageway for inducing a swirling motion to the secondary air discharging from the outer annular passageway into the furnace combustion zone.

11 Claims, 6 Drawing Sheets

DUAL FUEL BURNER FOR A SHORTENED FLAME AND REDUCED POLLUTANT EMISSIONS

FIELD AND BACKGROUND OF THE INVENTION

The present invention relates generally to the field of commercial and industrial power generation, and in particular to a new and useful injector for gas-fired burners used in furnaces.

There are four main methods for firing natural gas in large-scale, commercial fossil fueled burners. Two of these methods, depicted in FIGS. 1A and 1B, contemplate a plurality of separate, equally spaced natural gas injection nozzles (spuds) mounted in the swirling air zones near the burner exit. In a third method, multiple longitudinal spuds are arranged in a circular array, as shown in FIG. 1C. As can be seen in FIGS. 1A, 1B and 1C, these three burner arrangements all employ a common manifold to distribute the natural gas among a multitude of gas spuds, adding a substantial level of undesirable complexity. The burner arrangements of FIGS. 1A and 1B also require the spuds to be placed in fixed positions in the air zones. Notably, each individual spud may have one or more holes drilled into it in order to direct gas flowing therethrough.

Undesirable complexity is further compounded in burners designed to fire both gas and pulverized coal, either alone or in combination, using multiple axial gas spuds. The spuds are difficult to fit in the burner without interference with the coal nozzle and elbow assembly, and are not easily retracted for protection from heat and slag during coal-only firing.

In contrast, the fourth arrangement, shown in FIG. 1D, employs a single gas injection nozzle, i.e. a single gas injector or "super spud", positioned in the center of the burner. In this fourth arrangement, natural gas flows from a pipe into a large, single gas element and disperses through multiple holes drilled at its discharge tip. Known super spud elements do not impart any swirling component to the discharged gas, so that the natural gas is discharged from the injection holes with only axial and/or radial velocity components, i.e. without a tangential component to the velocity. FIGS. 4A and 5A illustrate such a prior art single gas injector 100*a* in which each injection hole 120 is formed straight through the end wall 170 of the injector 100*a*. The injection holes 120 are arranged equally spaced around a center hole 110.

Previous firing of natural gas at 100 million Btu/hr in a large-scale test facility via multiple spuds in a fossil fuel burner, similar to the arrangement shown in FIG. 1A, resulted in acceptably short or transparent flames, but very high $NO_x$ concentrations (>600 PPMV or 0.7 lb $NO_2/10^6$ Btu). This arrangement did not include the use of flue gas recirculation (FGR) or overfire air (OFA). FGR is a proven $NO_x$ reduction technique in which a portion of flue gas from the boiler exit is mixed with the secondary air and introduced into burner. $NO_x$ levels can also be reduced by using OFA, which is a process where part of the combustion air is diverted from the burner and injected above the flame zone for substoichiometric burner operation.

Large-scale testing of a burner equipped with multiple axial spuds encircling the inner wall of a central core pipe, similar to the arrangement shown in FIG. 1C, achieved lower $NO_x$ concentrations (165 PPMV $NO_x$ or 0.18 lb $NO_2/10^6$ Btu) compared to the arrangement of FIG. 1A, and produced 16 PPMV CO at 9% excess air and 100 million Btu/hr, again without FGR or OFA. Under these conditions the flame length was 24–26 feet. While these levels of $NO_x$, CO and flame length are presently acceptable, this arrangement, as noted above, is mechanically complex.

Single element centerline, or super spud, firing of natural gas in three different fossil fuel burners, using an arrangement similar to FIG. 1D, generated 67 to 88 PPMV $NO_x$ (0.08 to 0.10 lb $NO_2/10^6$ Btu) with luminous, 28 to 30 ft long flames at 100 million Btu/hr firing rate and 9% excess air level.

As demonstrated by the above results, single element centerline (super spud) gas firing, via the arrangement of FIG. 1D, seems to be more attractive than firing by multiple spuds, via the arrangement of FIG. 1C, due to low $NO_x$ emissions and mechanical simplicity. Nevertheless, despite the significantly lower $NO_x$ emissions, natural gas injection through a single centerline super spud has resulted in long flame lengths. These longer flames can impinge on the opposite walls of shallow depth boilers or furnaces, resulting in poor heat absorption and deterioration of combustion.

In contrast, the arrangements of FIGS. 1A and 1B, with spuds mounted in the swirling air zones, produce short or transparent flames, but with high $NO_x$ performance. Multiple longitudinal spuds in the burner core zone, the arrangement of FIG. 1C, generated higher $NO_x$ levels than the centerline super spuds, in addition to luminous flames exceeding the length of those observed for peripheral spuds.

Therefore, a better way of discharging natural gas and other gaseous fuels from fossil fuel burners is needed to reduce the flame length without significantly increasing the $NO_x$ emissions.

SUMMARY OF THE INVENTION

It is therefore an object of the present invention to provide a gaseous fuel injector for a burner, which simultaneously produces short flames and low CO and $NO_x$ emissions via unique drilling patterns. The gas injector is connected to a supply pipe extending to the burner opening at the furnace wall. The drilling pattern in the injector imparts a swirling action to the gaseous fuel jets as they emerge from the discharge holes. Mixing between the gaseous fuel and air is improved relative to non-swirling fuel jets, resulting in significant reductions in the flame length and CO emissions, and $NO_x$ emissions comparable to other single gas injectors.

Accordingly, in one embodiment, the subject invention provides an injector for discharging a gaseous fuel through a burner into the combustion zone of a furnace or boiler for producing a shortened burner flame with reduced levels of CO and $NO_x$ emissions. The injector includes a chamber for transporting the gaseous fuel along a flow path, and has a longitudinal chamber axis and an end wall. Several peripheral openings are circumferentially spaced about the chamber axis on the end wall. Each opening has an inlet, an outlet, and a longitudinal opening axis. Each opening axis is inclined at a first acute angle greater than zero with respect to the chamber axis, and is further inclined, in a direction toward an adjacent peripheral opening, at a second acute angle greater than zero.

It is another object of the invention to provide a burner assembly designed to fire both gas and pulverized coal and having a gas injector that is easier to fit in the burner without interference with the coal nozzle and elbow assembly.

It is yet another object of the invention to provide a burner assembly designed to fire both gas and pulverized coal and having a gas injector that is easily retracted for protection from heat and slag during coal-only firing.

Accordingly, in a second embodiment, the subject invention provides a burner assembly for burning a gaseous fuel that produces a shortened flame with reduced levels of CO and $NO_x$ emissions. The assembly includes a gaseous fuel supply pipe having an inlet end and an outlet end, and defining a conduit for conveying a gaseous fuel therethrough. The supply pipe is connected at its outlet end to an injector which is formed with a chamber for transporting the gaseous fuel along a flow path, and has a longitudinal chamber axis and an end wall. Several peripheral openings are circumferentially spaced about the chamber axis on the end wall. Each opening has an inlet, an outlet, and a longitudinal opening axis. Each opening axis is inclined at a first acute angle greater than zero with respect to the chamber axis, and is further inclined, in a direction toward an adjacent peripheral opening, at a second acute angle greater than zero for inducing a swirling motion to the gaseous fuel discharging from the injector into the combustion zone. A first sleeve member is concentrically spaced about the injector and the supply pipe to form an inner annular passageway which has an outlet adjacent the end wall. The inner annular passageway can be used for transporting air or a mixture of air and pulverized coal to the combustion zone. A second sleeve member is concentrically spaced about the first sleeve member to form an outer annular passageway for transporting secondary air to the combustion zone. A plurality of circumferentially spaced vanes are mounted within the outer annular passageway for inducing swirling motion to the secondary air discharging from the outer annular passageway into the combustion zone.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1A:
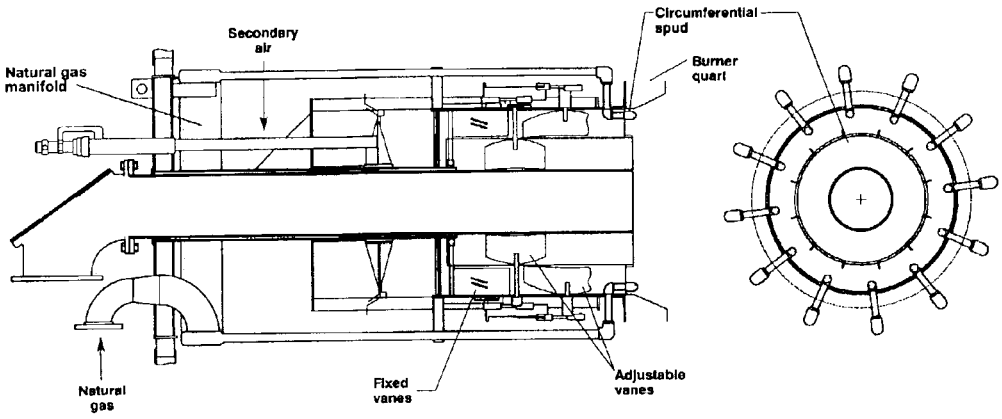
FIG. 1A (Prior Art)
FIGS. 1A, 1B, 1C and 1D are prior art natural gas injector arrangements.
Figure 1B:
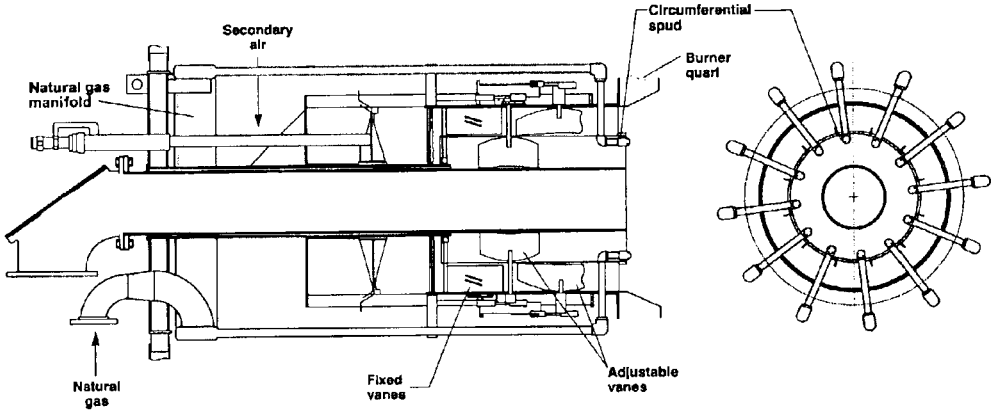
FIG. 1B (Prior Art)
Figure 1C:
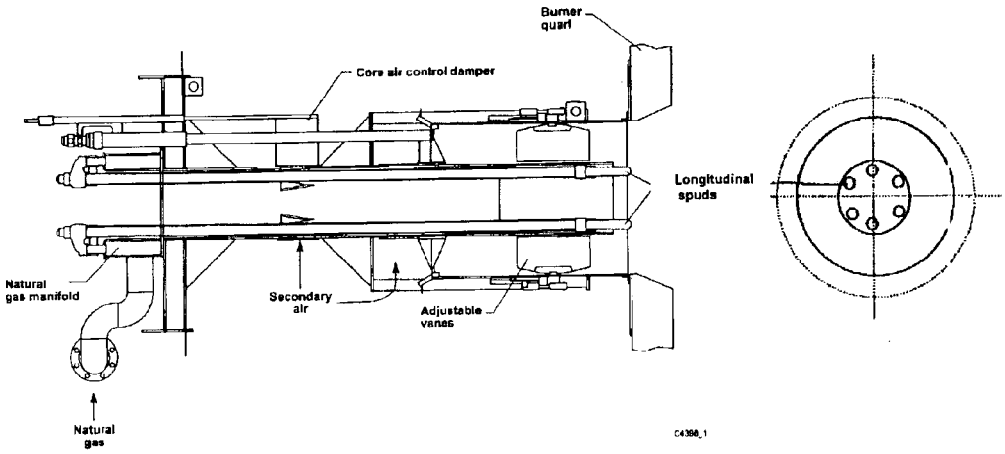
FIG. 1C (Prior Art)
Figure 1D:
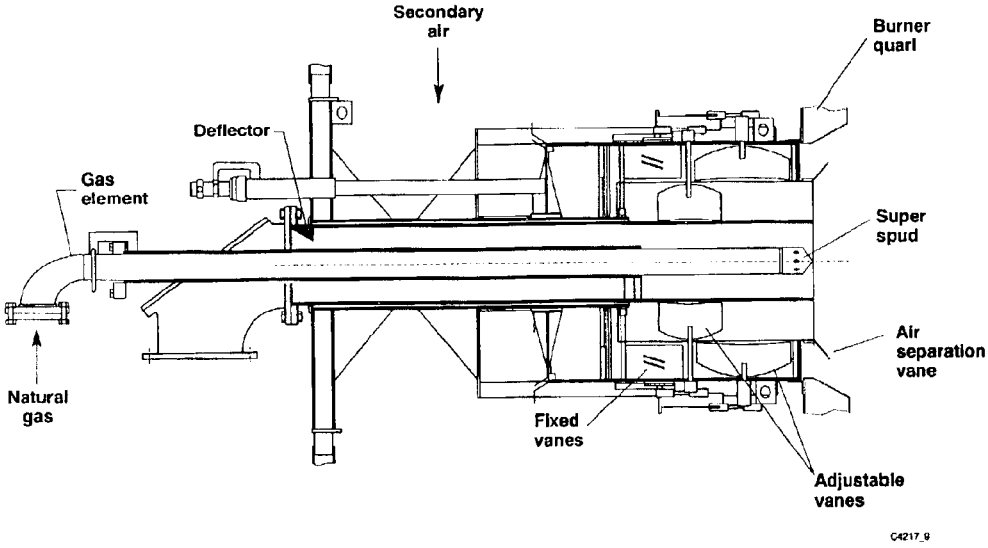
FIG. 1D (Prior Art)
Figure 2:
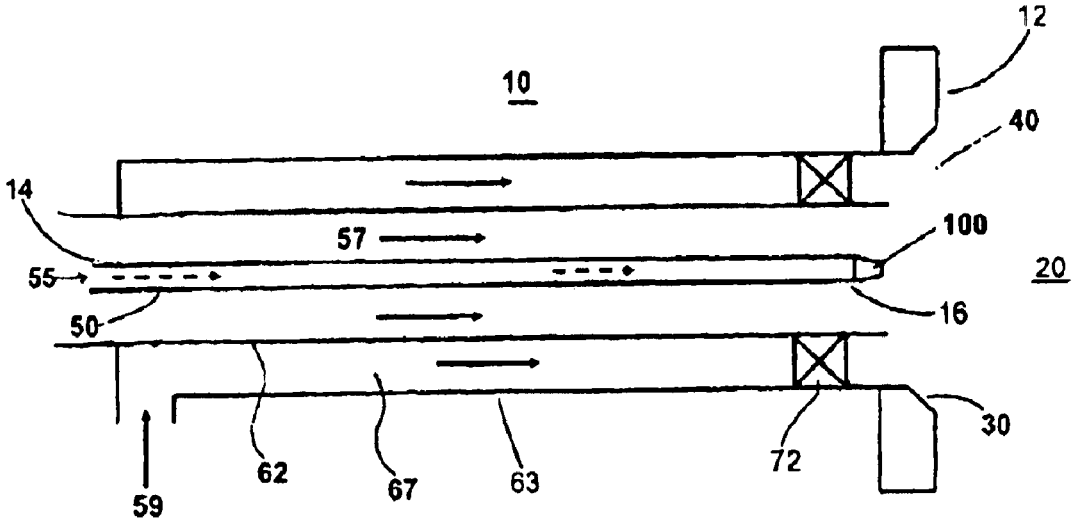
FIG. 2 is a schematic partial sectional side view of a burner arrangement suitable for burning pulverized coal and/or natural gas in a furnace using the gaseous fuel injector in accordance with the invention.

Referring now to the drawings, in which like reference numerals are used to refer to the same or similar elements, FIG. 2 shows part of a boundary wall 12 of a furnace and a burner 10 having a gaseous fuel supply pipe 50 formed with an inlet end 14 and an outlet end 16, and a gas injector element 100 attached to the outlet end 16 and extending into the furnace wall burner opening or port 40 as defined by the burner throat 30. A first sleeve member 62 is concentrically spaced about the supply pipe 50 and the injector 100 to form an inner annular passageway 57 for conveying a mixture of air and pulverized coal to the combustion zone 20. A second sleeve member 63 is concentrically spaced about the first sleeve member 62 to form an outer annular passageway 67 for conveying secondary air 59 to the combustion zone 20. The secondary air stream 59 for combustion flows into the outer annular passageway 67 which is provided with swirl vanes 72 for distribution and mixing of air with combustion gases in the flame as it exits the burner opening 40. A gaseous fuel 55, such as natural gas, is provided through the supply pipe 50. In a variation of the invention, primary air and pulverized coal may also be injected via inner annular passageway 57 into the burner 10, either separately, or with a gaseous fuel supplied simultaneously via pipe 50 and injected into the combustion zone 20 by the injector element 100.

The gas injector element 100 is preferably positioned in the center of the burner 10 in burner throat 30. However, gas injector element 100 may be horizontally displaced within the burner 10 as well.

In use, a gaseous fuel 55, such as natural gas, passes through the supply pipe 50 to gas injector element 100, where it is injected into the furnace combustion zone 20 and ignited. Typically, a horizontally extending flame is generated at the gas injector element 100. Ideally, the flame from each burner 10 in a furnace extends across the furnace enclosure, but does not impinge on the opposing wall.

Figure 3:
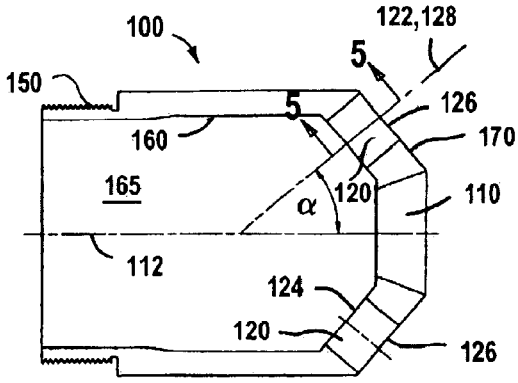
FIG. 3 is a sectional side view of an individual gas injector.

The gas injector element 100, as shown in section in FIG. 3, can be secured to the end of the supply pipe 50 via a threaded or welded connector 150. Inner walls 160 define a chamber 165 having several injector openings 110, 120 in the end wall 170. The center opening 110 may increase in diameter from the inner wall 160 to the exterior of the gas injector element 100. As shown in FIG. 3, peripheral injector openings 120 are most preferably oriented with their longitudinal opening axes 122 at a distinct first acute angle $\alpha$ in comparison to the longitudinal chamber axis 112. Ideally, $\alpha$ is between 10° to 45° relative to the longitudinal chamber axis 112, and most preferably set at about 40°, although greater and smaller angles are possible. This radial orientation of the peripheral openings 120 provides a diverging flow of gaseous fuel 55 as it leaves the gas injector element 100. Notably, the arrangement depicted in FIG. 3 can illustrate features common to both the prior art and the present invention. When the gas injector element 100 is secured to the supply pipe 50, gaseous fuel 55 passes into chamber 165 and exits through the peripheral openings 120 and center opening 110 into the furnace for combustion.

Figure 5A:
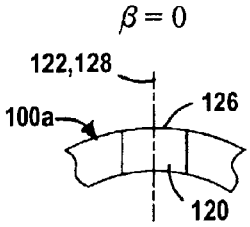
FIG. 5A (Prior Art)
FIG. 5A is a sectional view showing the orientation of a prior art gas injector, including the orientation of the injection openings.
Figure 4A:
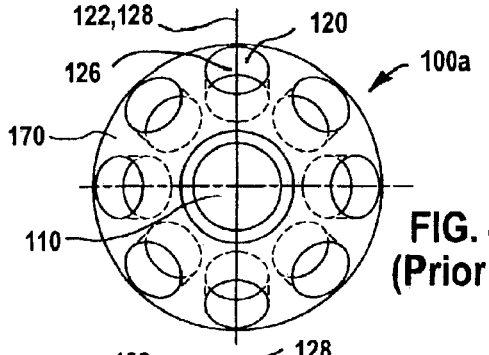
FIG. 4A (Prior Art)
FIG. 4A is an end view of a prior art gas injector, including the orientation of the injection openings.

What sets apart the present invention from the prior art is the pitched angle or tilt of the peripheral openings 120 that results in a swirling gaseous fuel flow pattern with superior performance characteristics. FIGS. 4A and 5A show the prior art arrangement wherein the orientation of the axes 122 of the peripheral openings 120 clearly creates a diverging pattern, but without imparting swirl to the gas exiting openings 110, 120.

Figure 4B:
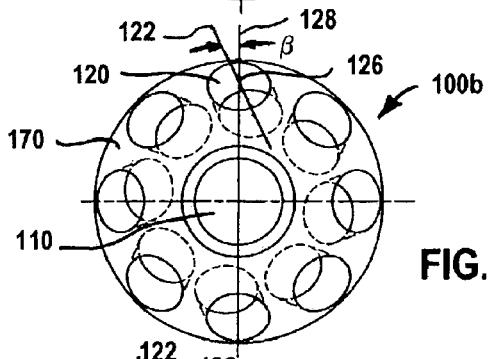
FIGS. 4B and 4C are end views of the present invention, including the orientation of the injection openings.
Figure 4C:
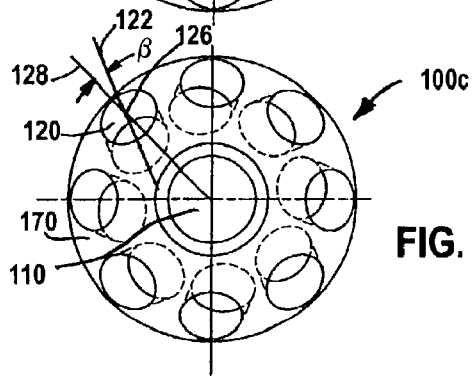

In contrast, FIGS. 4B and 4C distinctly illustrate two gas injector elements 100*b* and 100*c* according to the present invention. Each of the gas injector elements 100*b* and 100*c* of FIGS. 4B and 4C has peripheral openings 120 which are circumferentially spaced about chamber axis 112, and preferably has eight peripheral openings 120 which are spaced 45° apart. Unlike the prior art gas injector element 100*a* of FIG. 4A, the peripheral openings 120 in the elements 100*b* and 100*c* of FIGS. 4B and 4C are drilled through the gas injector end wall 170 at a second acute angle, or pitch β relative to the surface of the end wall 170. The angle β is defined by the intersection of an opening axis 122 with a reference line 128. As best seen in FIG. 3, reference line 128 extends from the chamber axis 112 at the above-mentioned first acute angle α. As shown in FIGS. 4B and 4C, reference line 128 intersects opening axis 122 at the opening outlet 126 of opening 120. The pitched orientation of the openings 120 provides a rotational (i.e. angular or tangential) velocity component to natural gas 55 passing through the peripheral openings 120.

Figure 5B:
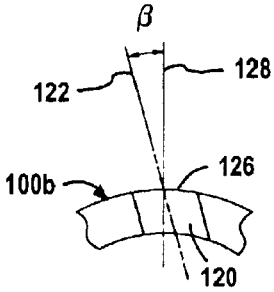
FIGS. 5B and 5C are sectional views showing orientations of gas injectors according to the present invention, including the orientation of the injection openings.
Figure 5C:
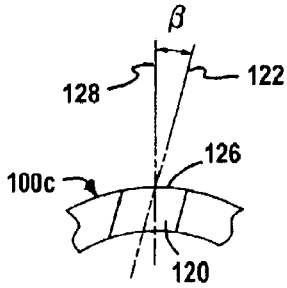

FIGS. 5B and 5C illustrate more details of the pitch angle β for the peripheral openings 120 relative to reference line 128. As shown in FIG. 5B, the peripheral openings 120 are set with the opening axis 122 oriented with a left pitch or angle β, for example about 15°, relative to reference line 128. The left pitch gives the natural gas fuel jets exiting the peripheral openings 120 a counter-clockwise (CCW) tangential spin (as viewed from the furnace looking toward the front of gas injector 100*b*) relative to the longitudinal chamber axis 112. The CCW tangential spin causes the natural gas 55 to swirl in a counter-clockwise direction as it discharges radially and axially from gas injector 100*b* through peripheral openings 120. This is in contrast to prior art injector 100*a*, shown in FIG. 5A, wherein β is zero, and opening axis 122 and reference line 128 coincide. FIG. 5C illustrates a gas injector element 100*c* of the present invention having a clockwise (CW) tangential spin provided by a 15° right pitch for each peripheral opening 120.

The combustion airflow supplied through the outer annular passageway 67 of the burner 10 around the gas injector element 100 may also be provided with a swirl pattern, produced by swirl vanes 72, as shown in FIG. 2. The direction of the combustion air swirl pattern can be the same or opposite of that for the CW- or CCW-oriented peripheral openings 120. The gaseous fuel swirl pattern is directly attributable to the pattern of pitched openings, and the inventors are unaware of any other single, gas injector arrangement that can impart swirl without the need for an array of multiple spuds, which entail complex mechanics and manifolds. Moreover, because the swirl is created in the core combustion zone 20 of the burner, rather than within the swirling air regions, the inventors believe performance is substantially enhanced in comparison to the prior art designs described above.

The gas injector elements 100*b* and 100*c* according to the present invention produce shorter flame lengths with reduced CO emissions and only slightly increased $NO_x$ emissions relative to the prior art conventional gas injection elements discussed above.

The gas injector elements 100*b*, 100*c* are designed preferably for use in burners 10 firing natural gas at a design flow rate although they may be used in higher or lower capacity situations. In a preferred embodiment, the gas injector elements is sized to accommodate several gas injection holes. The center opening 110 and the peripheral openings 120 are sized for natural gas injection velocities of 40,000 to 80,000 feet per minute at standard conditions.

Figure 6:
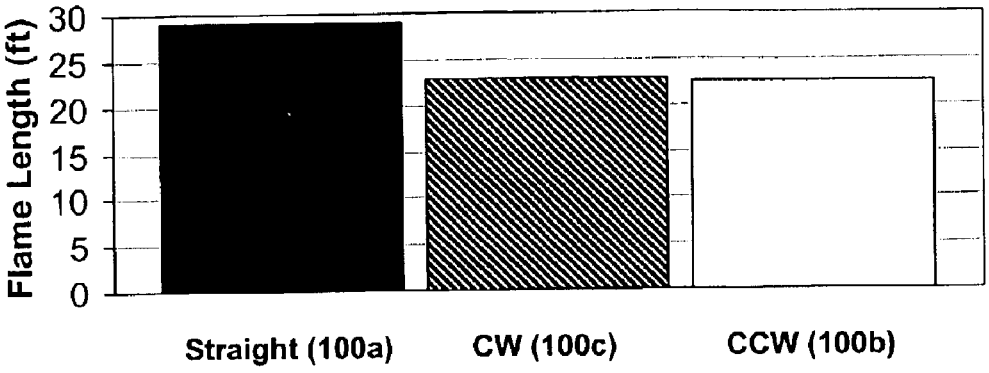
FIG. 6 is a graph illustrating flame length in feet for each of a straight injection opening, a clockwise injection opening and a counter-clockwise injection opening injector.
Figure 7:
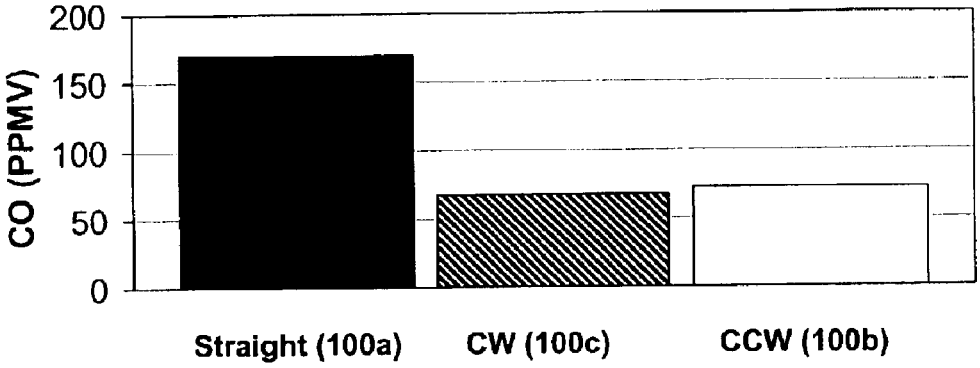
FIG. 7 is a graph illustrating CO levels in PPMV for each of a straight injection opening, a counter-clockwise injection opening and a clockwise injection opening injector.
Figure 8:
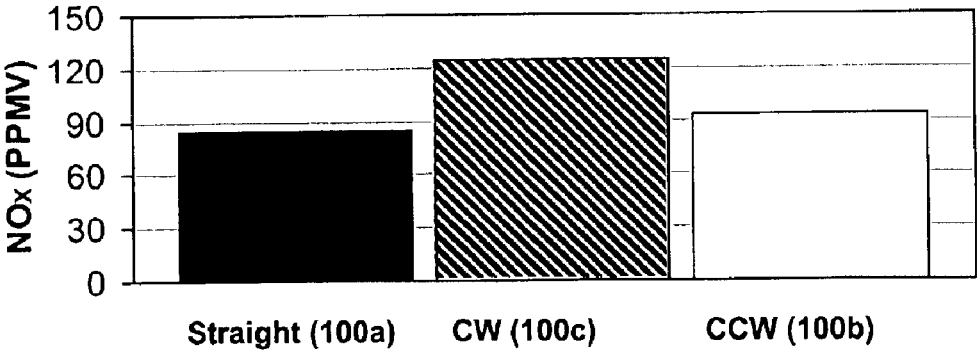
FIG. 8 is a graph illustrating $NO_x$ levels in PPMV for each of a straight injection opening, a counter-clockwise injection opening and a clockwise injection opening injector.

FIGS. 6–8 show the benefits of using gas injector elements 100*b* and 100*c* having the CCW- and CW-oriented peripheral openings 120 in a furnace. The results displayed in each of FIGS. 6–8 were obtained as follows.

Figure 9:
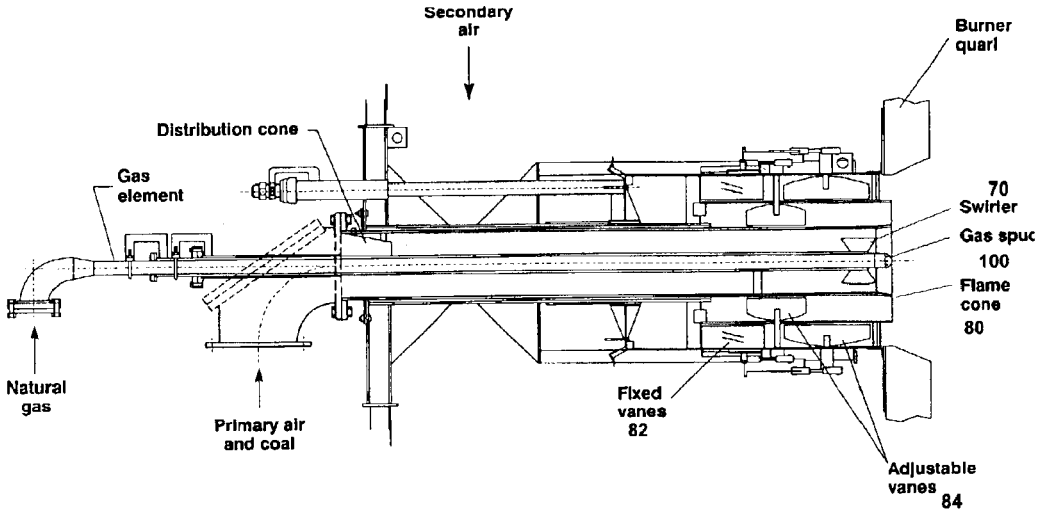
FIGS. 9 and 10 are partial sectional views of pulverized coal and natural gas burner arrangements for a furnace used to test the gas injector of the invention.

Natural gas firing using a single, centerline gas injector element inside the coal nozzle of a Babcock & Wilcox plug-in DRB-XCL PC burner (a registered trademark of The Babcock & Wilcox Company) was evaluated in a large-scale test facility. The burner was equipped with a recessed flame cone 80 and a multi-blade coal nozzle impeller 70 mounted around the centerline gas injector element, as shown in FIG. 9. The outer secondary air zone contained both fixed vanes 82 and adjustable vanes 84, and inner secondary air zone contained adjustable vanes 84. Several gas injector elements having different drilling patterns and injection hole diameters were installed in the burner separately for testing.

Among all gas injector elements 100 tested, the elements 100*b* and 100*c*, with either counter-clockwise or clockwise drilling pitches to the peripheral openings 120 had better overall performance with regard to $NO_x$, CO, and flame length.

For example, as shown by FIG. 6, the 100 million Btu/hr gas injector element 100*b* with CCW-oriented peripheral openings 120 produced a 23-ft. flame. Gas injector element 100*b* resulted in emissions of 72 PPMV CO at 10% excess air and 93 PPMV $NO_x$ (0.11 lb $NO_2/10^6$ Btu), as illustrated in FIGS. 7 and 8, respectively.

Under the same operating conditions, the flame length, CO emissions, and $NO_x$ emissions for the gas injector element 100*c* with CW-oriented peripheral openings 120 were 23 feet, 67 PPMV CO, and 124 PPMV $NO_x$ (0.14 lb $NO_2/10^6$ Btu) as seen in each of FIGS. 6–8, respectively.

By comparison, at the nominal conditions of 100 million Btu/hr and 10% excess air, the conventional gas injector element 100*a* with the straight peripheral openings of FIGS. 4A and 5A had a flame length of 28–30 feet, emitted 170 PPMV CO, and achieved 85 PPMV $NO_x$ (0.10 lb $NO_2/10^6$ Btu). These results are also shown in FIGS. 6–8, respectively.

Figure 10:
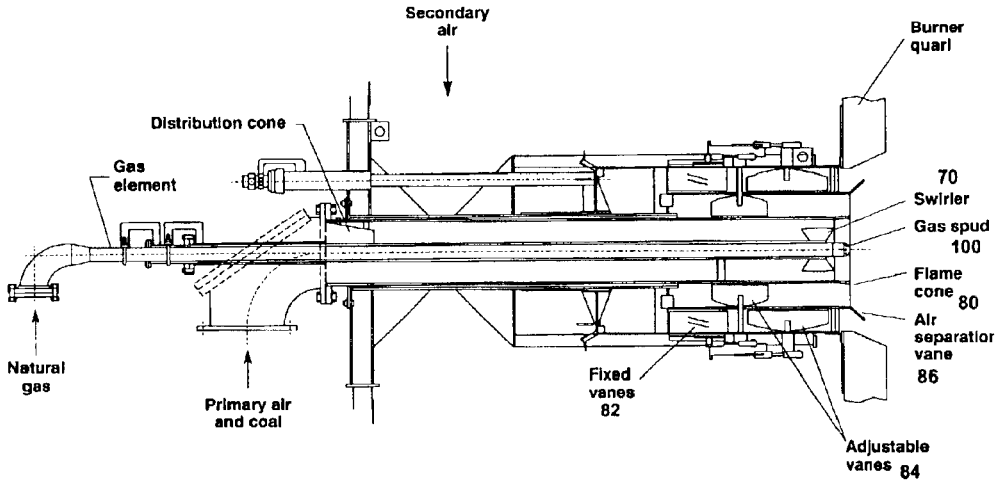

In a further test, a plug-in DRB-XCL PC burner was reconfigured as illustrated in FIG. 10, with an air distribution device, or air separation vane, 86 and a gas injector element 100 with peripheral openings 120 (i.e. gas injector elements 100*b* and 100*c*, as shown in FIGS. 4B and 4C) designed for a 70 million Btu/hr firing rate with natural gas. Gas injector element 100*c* (with CW-oriented peripheral openings 120) produced a flame length of only 17 feet, and emissions of 20 PPMV CO and 131 PPMV $NO_x$ (0.15 lb $NO_2/10^6$ Btu), when operated at 70 million Btu/hr and 10% excess air. Under the same operating conditions, gas injector element 100*b* (with CCW-oriented peripheral openings 120) produced an 18 foot flame length and emissions of 15 PPMV CO and 112 PPMV $NO_x$ (0.13 lb $NO_2/10^6$ Btu).

Although gas injector elements 100*b* and 100*c*, having eight peripheral openings 120 with opening axes 122 inclined at first acute angle α of about 400 with respect to the chamber axis 112, and a second acute angle or pitch angle β of about 15° CCW (100*b*) or CW (100*c*) had the best overall performances, it is anticipated that the number and diameter of the holes, pattern, and drilling angle (first angle and second, or pitch angle) could vary to suit the performance needs of particular applications. The precise variations will depend on the specific boiler/furnace geometry, firing rate, and desired emissions performance and flame shape and other factors.

While a specific embodiment of the invention has been shown and described in detail to illustrate the application of the principles of the invention, it will be understood that the invention may be embodied otherwise without departing from such principles.

What is claimed is:

1. In combination with the boundary wall of a boiler furnace, a combustion zone established within the furnace, at least one burner port formed in the boundary wall and fronting the combustion zone, a dual fuel burner facing the combustion zone through the burner port, and comprising:

an elongated supply pipe having an inlet end and an outlet end, and defining a conduit for conveying natural gas therethrough;

an injector connected to the outlet end of the supply pipe, the injector having a chamber communicating with the conduit, the chamber having a longitudinal axis and an end wall, wherein the diameter of the injector along the longitudinal axis prior to the end wall is substantially the same as the diameter of the elongated supply pipe;

a plurality of peripheral flow directing openings extending through the end wall in a circumferentially spaced array about the chamber axis, each opening having a longitudinal axis inclined at a first acute angle greater than zero with respect to the chamber axis, and each being further inclined, in a direction toward an adjacent peripheral opening, at a second acute angle greater than zero for inducing swirling motion to the natural gas being injected into the combustion zone;

a first sleeve member concentrically spaced about the supply pipe and the injector to form an inner annular passageway for conveying a mixture of primary air and pulverized coal separately from the natural gas and into the combustion zone;

a swirler connected to the outlet end of the supply pipe, the swirler having a plurality of vanes positioned upstream of the injector;

a second sleeve member concentrically spaced about the first sleeve member to form an outer annular passageway for conveying secondary air to the combustion zone; and a plurality of circumferentially spaced vanes mounted within the outer annular passageway for inducing swirling motion to the secondary air discharging from the outer annular passageway into the combustion zone.

2. The combination according to claim 1, further including a central opening extending through the end wall concentric with the chamber axis.

3. The combination according to claim 1, wherein the peripheral openings induce the natural gas to swirl in a first rotational direction, and the vanes induce the secondary air to swirl in the same rotational direction as the natural gas.

4. The combination according to claim 1, wherein the peripheral openings induce the natural gas to swirl in a first rotational direction, and the vanes induce the secondary air to swirl in a second rotational direction different from that of the natural gas.

5. The combination according to claim 1, wherein the first acute angle is in the range of about 10° to 45°.

6. The combination according to claim 1, wherein the second acute angle is in the range of about 10° to 30°.

7. The combination according to claim 1, wherein the first acute angle is about 40°.

8. The combination according to claim 1, wherein the second acute angle is about 15°.

9. A method for reducing flame length and CO and $NO_x$ emissions from the combustion of fuel, including a boundary wall defining a boiler furnace, a combustion zone established within the furnace, at least one burner port formed in the boundary wall and fronting the combustion zone, means for supplying primary air, secondary air, natural gas and pulverized coal to the combustion zone including a dual fuel burner facing the combustion zone through the burner port, the dual fuel burner having a supply pipe, an injector connected to the supply pipe wherein the diameter of the injector is substantially the same as the diameter of the supply pipe, the injector including openings for inducing swirling, means forming an inner annular passageway about the supply pipe and injector, swirling means connected to the supply pipe within the inner annular passageway, means forming an outer annular passageway about the inner annular passageway, and swirl vanes mounted within the outer passageway, and comprising the steps of:

conveying the natural gas through the supply pipe and the injector;

inducing swirling motion to the natural gas being injected into the combustion zone through the openings;

conveying a mixture of primary air and pulverized coal through the inner annular passageway separately from the natural gas and into the combustion zone;

conveying secondary air through the outer annular passageway and into the combustion zone; and inducing swirling motion to the secondary air being conveyed into the combustion zone.

10. The method according to claim 9, wherein the natural gas is induced to swirl in a first rotational direction, and the secondary air is induced to swirl in the same rotational direction as the natural gas.

11. The method according to claim 9, wherein the natural gas is induced to swirl in a first rotational direction, and the secondary air is induced to swirl in a second rotational direction different from that of the natural gas.

* * * * *